US005136277A

United States Patent [19]

Civanelli et al.

[11] Patent Number: 5,136,277

[45] Date of Patent: Aug. 4, 1992

[54] DEVICE FOR DETECTING THE PRESENCE OF A FOOD COOKING CONTAINER ON A COOKING HOB

[75] Inventors: Claudio Civanelli, Travedona; Enrico Vasconi, Varano Borghi; Daniele Turetta, Ispra; Carlo Montanari, Milan, all of Italy

[73] Assignee: Whirlpool International B.V., Eindhoven, Netherlands

[21] Appl. No.: 614,891

[22] Filed: Nov. 16, 1990

[30] Foreign Application Priority Data

Nov. 17, 1989 [IT] Italy ..... 22423 A/89

[51] Int. Cl.[5] ..... G08B 21/00

[52] U.S. Cl. ..... 340/568; 219/452; 219/519

[58] Field of Search ..... 340/568; 219/519, 452; 99/337, 338

[56] References Cited

U.S. PATENT DOCUMENTS

| | | | |
|---|---|---|---|
| 3,018,356 | 1/1962 | Busch et al. | 219/519 |
| 4,070,670 | 1/1978 | Chen | 219/519 |
| 4,577,181 | 3/1986 | Lipscher et al. | 219/452 |

*Primary Examiner*—Glen R. Swann, III

*Attorney, Agent, or Firm*—Thomas J. Roth; Stephen D. Krefman; Thomas E. Turcotte

[57] ABSTRACT

A device is provided for detecting the presence of a food cooking container (9) placed on a cooking hob (1), in particular of glass ceramic, provided with at least one heater element such as an electrical resistance element (2, 40, 41, 42), a gas burner (30), a halogen lamp or the like includes at least two plates (11, 12) of electrically conducting material associated with the hob (1) and connected to an electrical circuit (13), and being of opposite polarities, said plates acting as plates of a capacitor, i.e. forming a capacitive sensor the capacitance of which changes when the food container is placed on the hob (1) in a position corresponding with said plates (11, 12), the change in capacity of said capacitor being sensed by the electrical circuit (13), which therefore detects the presence of said container (9), to generate a control signal as a result of such detection. This signal is fed to indicator means (20) to indicate which heater element has to be operated to heat the container. The signal is also used to modify the energy feed to each heater element (2; 30; 40, 41, 42), either by switching it on and/or off or by reducing its power.

17 Claims, 2 Drawing Sheets

DEVICE FOR DETECTING THE PRESENCE OF A FOOD COOKING CONTAINER ON A COOKING HOB

This invention relates to a cooking hob in which below a surface of suitable material (such as glass ceramic) there are located one or more heater elements or heat sources in the form of electrical resistance elements, gas burners, halogen lamps or the like.

SUMMARY OF THE INVENTION

An object of the invention is to provide a cooking hob in which the heater elements can be switched on and off automatically (and/or their output power reduced) when a normal pan or food cooking container is placed on it (or removed).

A further object is to provide a cooking hob in which after the food container (such as a saucepan) has been placed on it an indication is given of which heat source must be switched on to heat the food in said container.

A further object is to provide a cooking hob in which the temperature attained by the heat source (and thus by the food) can be automatically controlled, and in which this temperature can be adjusted according to requirements.

A further object is to provide a cooking hob in which, depending on the particular size of the saucepan used, several adjacent heat sources can be automatically operated to allow uniform heating of any type of saucepan.

These and further objects are attained by a device for detecting the presence of a food cooking container placed on a cooking hob, in particular of glass ceramic, provided with at least one heater element such as an electrical resistance element, a gas burner, a halogen lamp or the like, characterized by comprising at least two plates of electrically conducting material associated with the hob and being of opposite polarities, said plates acting as plates of a capacitor, i.e. forming a capacitive sensor the capacitance of which changes when the food container is placed on the hob in a position corresponding with said plates, the change in capacitance of said capacitor being sensed by an electrical circuit for detecting the presence of said container, and which electrical circuit generates a control signal as a result of such detection.

The present invention will be more apparent from the accompanying drawing, which is provided by way of non-limiting example and in which:

DETAILED DESCRIPTION OF THE PREFERRED EMBODIMENTS

Figure 1:
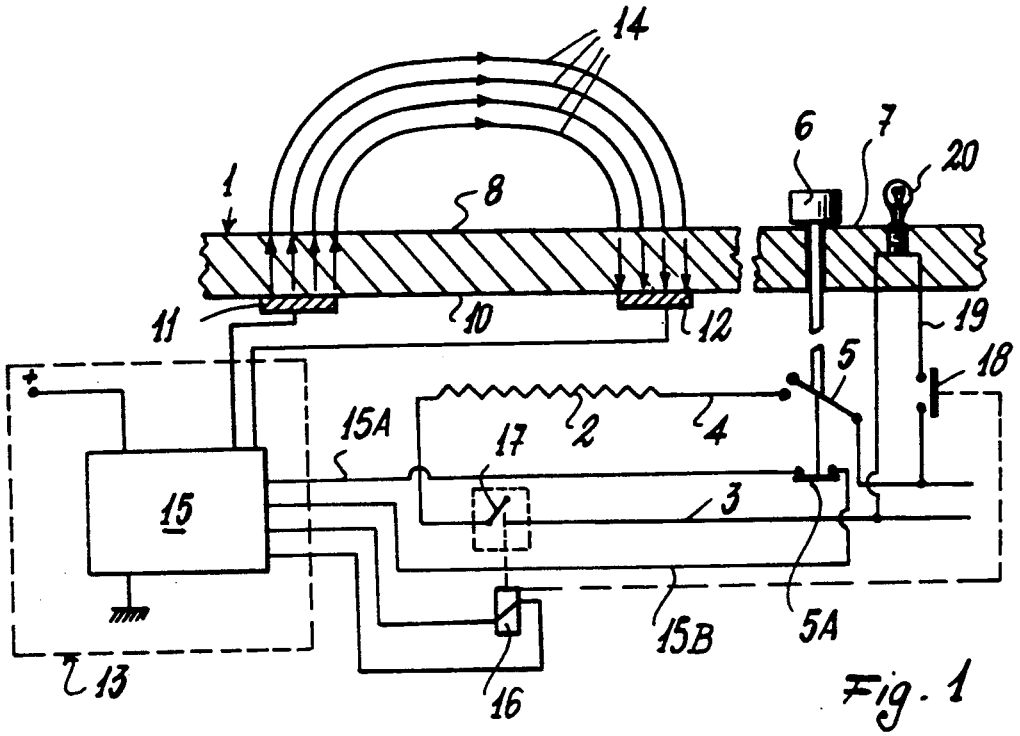
FIG. 1 is a schematic cross-section through a cooking hob constructed in accordance with the invention and with which a heater element of electrical resistance type is associated.

FIG. 1 shows a cooking hob 1, for example of glass ceramic, with which a heater element is associated consisting of a resistance element 2 powered via electrical lines 3 and 4. The line 4 comprises a normal contactor 5 operable in known manner by a knob 6 located on a control panel 7 associated with the hob 1. This knob also operates a further contactor 5A which acts on lines 15A and 15B with the opposite effect to that of the contactor 5 on the line 4.

The hob 1 has an upper surface on which there is placed a usual saucepan (not shown in FIG. 1 but shown in FIGS. 2 and 3) for containing a food which for example is to be cooked. Said hob is also provided with a lower surface 10.

According to one characteristic of the invention, two thin plates or layers 11 and 12 of electrically conducting material are arranged on and associated in any known manner with the lower surface 10 of the hob 1, and are connected to an electrical circuit 13. Said plates have opposite polarities and form the plates of a capacitor to form a capacitive sensor in which the lines of force of the electrical field 14 are lines which commence at the plate 11, pass through the hob 1 (i.e. the glass ceramic dielectric) perpendicular to it, then curve into the air layer above said hob (i.e into the air dielectric) and then turn perpendicularly into the glass ceramic dielectric to reach the plate 12.

Figure 4:
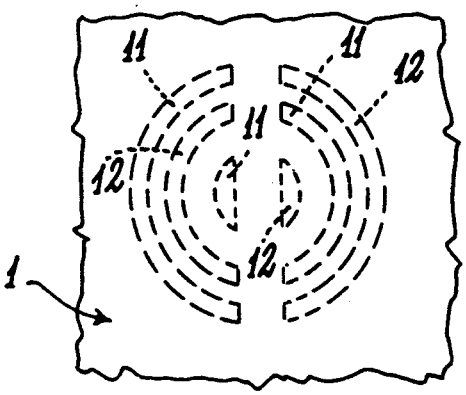
FIG. 4 is a plan view of the cooking hob of FIG. 3, from which the saucepan has been removed.

It should be noted that the plates 11 and 12 of said capacitor are formed in such a manner as to obstruct the flow of heating energy to the least possible extent, by being given an appropriate shape (as shown for example in FIG. 4).

The plates can also be formed by a silk-screen process, and thus as layers, on the lower surface of the hob 1, or can be totally or partly embedded in the constituent glass ceramic material of said hob.

The plates 11 and 12 are connected to a capacitance monitoring means 15 which forms part of the circuit 13 and senses any change in capacitance of the capacitor formed by said plates. The monitoring means 15 is connected to a usual electrical energy source (not shown). Said monitoring means 15 is advantageously a microprocessor circuit, but can also be a normal bridge for measuring the capacitance of a capacitor.

The lines 15A and 15B extend to the microprocessor. Via said lines the microprocessor can sense whether the knob 6 has been set in a position which enables the resistance element 2 to operate (e.g. a position in which contactor 5 is closed in the line 4) or whether it has been set in a position which does not enable said resistance elements to be powered (e.g. in a position in which contactor 5 is open). In the first case, i.e. in which the resistance element 2 is connected, the contactor 5A is open, whereas in the second case, i.e. in which the resistance element disconnected, the contactor 5A is closed.

The lines 15A and 15B act as a safety circuit by which, as explained hereinafter, the microprocessor knows whether the user wishes to heat the object placed on the cooking hob 1 over the plates 11 and 12.

The monitoring means or microprocessor 15 is also connected to a relay 16 operating a contactor 17 in the electrical line 3 which feeds the resistance elements 2. The relay also operates a further contactor 18 in a line 19 which powers a normal lamp 20 (or other known luminous indicator means). The lamp 20 is positioned to the side of the knob 6. Alternatively it can be incorporated in the knob.

In the situation shown in FIG. 1, i.e. without any saucepan on the hob 1, the total capacity of the capacitor formed by the plates 11 and 12 has a defined value, measurable by the microprocessor 15. It will now be assumed that a saucepan is placed on the surface 8 of the cooking hob, but without initially setting the knob 6 to the position which enables the resistance element 2 to operate. The presence of the saucepan on said hob changes the total capacitance measured by the microprocessor 15. As a result of this measurement, and in accordance with a set program, the microprocessor powers the relay 16, which closes the contactors 17 and 18, thus making the resistance elements ready for operation and lighting the lamp 20 to the side of the knob 6. The user now has a visual indication of which knob has to be operated to close the contactor 5 and thus operate the heater element 2.

The user therefore operates the knob 6 to close the contactor 5 in the line 4, thus powering the resistance element 2. At the same time the contactor 5A is opened.

If the saucepan is removed from the hob 1 without firstly setting the knob 6 to open the contactor 5 (i.e. without disconnecting the supply from the resistance element 2), the microprocessor 15 notes the corresponding change in the capacitance of the capacitor formed by the plates 11 and 12. In accordance with a set program, the microprocessor switches off the feed to the relay 16, which therefore opens the contactors 17 and 18.

In this manner, power is removed from the resistance element 2, which therefore cools down.

If, while the resistance element 2 is still hot, another food (or other) container is placed on the cooking hob 1 above the plates 11 and 12, the microprocessor 15 will not allow the resistance element 2 to be powered (by closing the contactor 17 via the relay 16) unless the knob 6 is first moved its initial position in which said resistance element could not be powered.

In this respect, if the knob 6 is not moved into the stated position and the contactor 5 therefore does not open, the contactor 5A remains open in the state attained during the previous operation of the resistance element.

In such a situation, the microprocessor senses the presence of the container on the cooking hob but does not detect any signal along the lines 15A and 15B. Consequently, in accordance with a set program, as the microprocessor 15 does not detect any enabling signal for the operation of the resistance element 2 along these lines, it does not allow the contactors 17 and 18 to be closed by the relay 16.

This prevents the heat source from becoming active when not desired, and burning or damaging objects which are placed on the cooking hob 1 in error.

Thus the said lines 15A and 15B and the contactor 5A operated by the knob 6 define a safety circuit by which the microprocessor is able both to know the requirements of the user and to heat the food container placed on the hob 1.

Consequently, if after the food container has been removed from the hob 1 a second container is placed on the hob, the resistance element is powered only if firstly the user returns the knob to its initial position (zero position), to close the contactor 5A in the lines 15A and 15B.

In a modified embodiment, not shown, the microprocessor 15 controls a direct current electric motor, preferably of stepping type, which operates the knob 6. When the container is removed from the cooking hob 1, the microprocessor operates said motor, which automatically returns the knob 6 to its zero position. In this manner, the contactor 5 is opened and there is no possibility of the resistance element being powered if an object is placed on the cooking hob in error, thus preventing any possibility of damage to the object.

It should be noted that the lamp 20 can be omitted (and with it the related electrical connections). In such a case, use of the capacitive sensor formed by the plates 11 and 12 will merely allow the presence or absence of the saucepan on the heat source 2 to be detected. On this basis, as stated, the microprocessor 15 enables the resistance element 2 to be powered when the saucepan is present, and disconnects it via the relay 16 when the saucepan is absent.

The function of visually indicating which knob 6 is associated with the heater element 2 on which the saucepan is placed is obviously much more important if several resistance elements 2 are associated with the cooking hob 1. In this case the indication is very useful in preventing errors in turning on the correct heater element.

Finally, the lamps 20 can be positioned on a suitable heater element indicator panel, which could be located away from the knobs 6.

Figure 2:
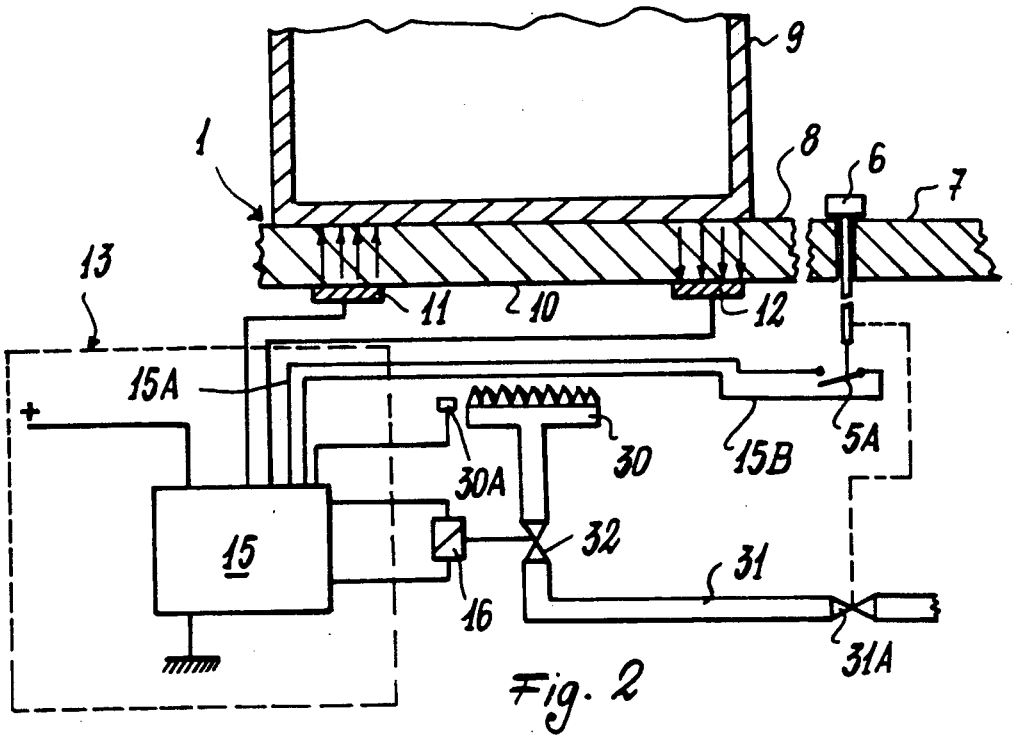
FIG. 2 is a view similar to that of FIG. 1, but showing a cooking hob with which a heater element of gas burner type is associated, and on which a normal saucepan has been placed.

FIG. 2 shows a cooking hob with which at least one heater element in the form of a gas burner is associated, and on which a food container is placed. In said figure, parts corresponding to those of FIG. 1 are indicated by the same reference numerals, and other parts have been omitted for greater clarity. As stated, in the Figure under examination, the heat source is a gas burner 30 connected to a feed line 31 in which a solenoid valve 32 controlled by the relay 16 is positioned. In this example the contactor 5A is still present, but instead of the contactor 5 there is a valve 31A controlled in any known manner by the knob 6. This valve opens or shuts off gas to the burner 30. In FIG. 2 (or in FIG. 3) there is no indicator device (lamp 20) shown for simplicity, however such a device could be provided. The use of the cooking hob 1 of FIG. 2 is the same as that of FIG. 1. However, in the case illustrated in FIG. 2, the microprocessor 15 on sensing a change in the capacitance of the capacitor (or capacitive sensor) formed by the plates 11 and 12, causes the relay to operate the solenoid valve 32, which then acts on the gas feed to the burner 30 to change its state of operation. At the same time it powers a spark generator 30A which ignites the flame at the burner 30. The generator 30A also acts as a flame detector.

To enable the gas to reach the burner, the user has to rotate the knob 6 (to displace it from its zero position), thus operating the valve 31A.

The "enabling" lines 15A and 15B comprising a contactor 5A operationally connected to the knob 6 are also present, said lines, in the already described manner, preventing gas reaching the burner unless the user so desires.

Figure 3:
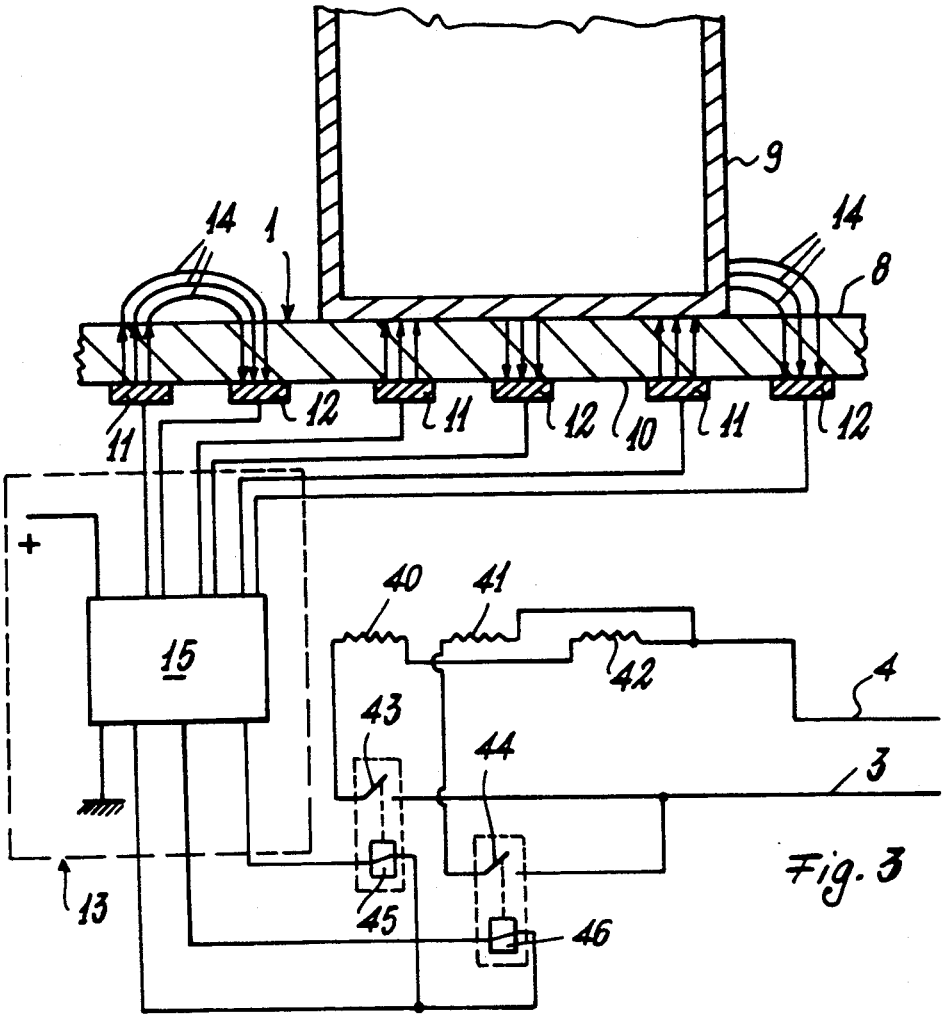
FIG. 3 is a view similar to that of FIG. 1 but with some parts omitted for clarity and showing a cooking hob provided with several resistance heater elements.

FIGS. 3 and 4 show a cooking hob 1 with which several pairs of plates 11 and 12 are associated to define a series of capacitors (or adjacent capacitive sensors). In said Figures, parts corresponding to those of FIG. 1 are indicated by the same reference numerals. Again in this Figure, some parts have been omitted for greater clarity.

FIGS. 3 and 4 show several heater elements (resistance elements) 40, 41, 42 connected to electrical feed lines 3 and 4 in which contactors 43 and 44 are positioned. These contactors are opened and closed by relays 45 and 46, which can be operated separately to enable only one, or more than one or all heater elements to be simultaneously powered.

This differential powering of the resistance elements 40, 41, 42 is based on the sensing of a change in the capacitance of one or more capacitors associated with the cooking hob 1 (comprising the plates 11 and 12), this sensing being done by the microprocessor 15.

For example, in the case shown in FIG. 3 and with reference thereto, the capacitance of the capacitor positioned centrally in the hob 1 varies considerably as the saucepan 9 covers both plates 11 and 12 of the capacitor. In contrast, the capacitance of the capacitor to the left of the hob 1 is not covered by the saucepan and its capacitance therefore does not vary. At the same time the capacitance of the capacitor to the right, only partly covered by the saucepan 9, undergoes a negligible variation.

As a result of this, the microprocessor 15 senses the change in the capacitance of the central capacitor and activates only the relay 46, which closes the contactor 44 to power only the resistance element 41. In this manner the hob 1 is heated only at the point in which the saucepan is positioned, thus preventing any energy wastage by also heating hob regions on which the saucepan 9 does not rest.

Summarizing, the microprocessor 15 senses which capacitor or capacitors change their capacitance when the saucepan 9 is placed on the hob 1, and the extent of the change, thus enabling the heat sources to be powered differently and the dimensions of said saucepan to be calculated.

Consequently, in this manner it is possible to select, for example in the case of a hob 1 with electrical heat sources, which resistance elements or halogen lamps to use to obtain the desired treatment for the food.

A further application of the invention is based on the fact that the physical characteristics of glass-ceramic change with temperature. On this basis the invention can be used to measure the variation in the temperature of the cooking hob.

In this respect, by means of a suitable program the microprocessor 15 can evaluate the variation in the dielectric constant or the variation in the resistivity of the material, making it possible to operate with constant controlled temperature or to act on the heater elements to vary the heat emitted by them by varying the power to said elements thus controlling the food treatment. Said power variation is again achieved by the microprocessor 15, which activates known means for varying the electrical feed to the resistance elements 2, 40, 41 and 42 or the gas feed to the burner 30. In this latter case, the variation can be obtained by acting on the solenoid valve 32.

The device of the invention also enables the presence of any type of cooking container to be detected, including a non-metal container. In this respect, in all cases following the placing of a container on the hob 1 there is an increase in the total capacitance of the capacitor over which the container is placed. This is because by interposing another insulating material such as porcelain, terracotta etc. between the plates instead of air, there is an increase in the dielectric constant of the known mathematical formula for calculating the capacitance of a capacitor.

If the container is of metal, the increase in said capacitance is even greater.

We claim:

1. A device for detecting the presence of a food cooking container placed on a cooking hob (1) provided with at least one heater element which comprises at least two plates (11, 12) of electrically conducting material associated with the hob and of opposite polarities, said plates (11, 12) forming a capacitive sensor the capacitance of which changes when a food container (9) is placed on the hob (1) in a position corresponding to said plates (11, 12), the change, in capacitance of said capacitor being sensed by an electrical circuit (13), for detecting the presence of said container (9), which generates at least one control signal as a result of such detection.

2. A device as claimed in claim 1, wherein the control signal generated by the electrical circuit (13) is fed to indicator means (20) to indicate which heater element (2; 30; 40, 41, 42) has to be operated to heat the container (9) placed on the cooking hob (1).

3. A device as claimed in claim 2, wherein the indicator means are at least one lamp (20) associated with each of multiple knobs (6) by which corresponding heater elements are activated, said lamp (20) either being inserted into the corresponding knob (6) or being positioned to the side of it.

4. A device as claimed in claim 2, wherein the indicator means are located on a panel which indicates the arrangement of the heater elements (2; 30; 40, 41, 42) and is associated with the cooking hob (1).

5. A device as claimed in claim 1, wherein the control signal generated by the electrical circuit (13) is arranged to modify the energy feed to each heater element (30).

6. A device as claimed in claim 5, wherein the control signal controls the switching on and/or switching off of each heater element (30).

7. A device as claimed in claim 1, comprising enabling means (5A, 15A, 15B) connected to the electrical circuit (13) and arranged to enable said circuit (13) to act only when such action is desired by the user.

8. A device as claimed in claim 1, wherein enabling means are present in the form of a contactor (5A) operationally connected to a knob (6) relating to each heater element, said contactor being positioned in electrical lines (15A, 15B) connected to the electrical circuit (13).

9. A device as claimed in claim 1, wherein the electrical circuit (13) comprises electronic control means in the form of a microprocessor circuit (15), arranged to evaluate the variation in the capacitance of the capacitor or capacitive sensor following the positioning of the food container (9) on the cooking hob (1).

10. A device as claimed in claim 9 wherein the control means (15) are connected to at least one relay (16; 45, 46) acting on interceptor members (17; 32; 43, 44) positioned in feed lines (3, 4; 31) to the heater elements (2; 30, 40, 41, 42).

11. A device as claimed in claim 10, wherein the interceptor members are contactors (17, 43, 44).

12. A device as claimed in claim 10, wherein the interceptor members are a solenoid valve (32).

13. A device as claimed in claim 1, wherein the electrical circuit (13) comprises electronic control means, and at least one bridge for measuring the capacitance of a capacitor, arranged to evaluate the variation in the capacitance of the capacitor or capacitive sensor following the positioning of the food container (9) on the cooking hob (1).

14. A device as claimed in claim 1, wherein the plates (11, 12) of electrically conducting material forming the capacitive sensor are arranged on the lower surface (10) of the hob (1).

15. A device as claimed in claim 1, wherein the plates (11, 12) of electrically conducting material forming the capacitive sensor are provided on the lower surface (10) of the hob (1) by a silk-screen process.

16. A device as claimed in claim 1, wherein in the plates (11, 12) of conducting material are embedded in the cooking hob (1).

17. A device as claimed in claim 1, wherein based on the measurement of the variation of the capacitance of the capacitive sensor, the electrical circuit (13) generates a control signal arranged to modify the feed to the heater element (2; 30; 40; 41, 42) so as to modify the heat generation by this latter, said control signal thus allowing said heater element to be temperature-controlled.

* * * * *